US006058920A

United States Patent [19]

Tentler

[11] Patent Number: 6,058,920

[45] Date of Patent: May 9, 2000

[54] BOWSTRING RELEASE WITH OVERLAPPING SINGLE JAW

[75] Inventor: Lynn A. Tentler, Fond du Lac, Wis.

[73] Assignee: Tru-Fire Corporation, N. Fond du Lac, Wis.

[21] Appl. No.: 09/159,145

[22] Filed: Sep. 23, 1998

[51] Int. Cl.[7] ..... F41B 5/18

[52] U.S. Cl. ..... 124/35.2

[58] Field of Search ..... 124/35.2

[56] References Cited

U.S. PATENT DOCUMENTS 4,498,448 2/1985 Fletcher ..... 124/35.2
4,567,875 2/1986 Fletcher ..... 124/35.2
5,448,983 9/1995 Scott ..... 124/35.2
5,803,068 9/1998 Summers ..... 124/35.2

*Primary Examiner*—John A. Ricci
*Attorney, Agent, or Firm*—Bracewell & Patterson

[57] ABSTRACT

A bowsting release has a single movable jaw that overlaps the outer end of a fixed jaw in order to retain a bowstring rather than utilizing an abutment surface on the fixed jaw. The bowstring release includes a fully calibrated trigger. The string retaining member is of a contoured, tapered configuration, permitting a sensitive trigger adjustment. The string is retained at the very tip of the fixed jaw, assuring a minimum of interference with the string as it is released from the mechanism.

18 Claims, 2 Drawing Sheets

BOWSTRING RELEASE WITH OVERLAPPING SINGLE JAW

BACKGROUND OF THE INVENTION

1. Field of the Invention

The subject invention is generally related to bowstring releases and is specifically directed to a bowstring release having a single jaw motion activated by a trigger.

2. Discussion of the Prior Art.

Bowstring releases have been utilized to enhance the accuracy of archers for many years. Numerous releases have been developed and a wide variety of designs and styles are available to accommodate the various needs and desires of the individual archer. Paul Peck and Lynn Tentler have been issued a large number of patents covering a wide range of bowstring release functions and designs. Tru-Fire Corporation, the assignee of the subject application, is the world leader in the design, manufacture and sale of bowstring releases.

In recent years, bowstring releases have fallen into several specific categories as defined by the trigger mechanism, the strap design and the notch/jaw configuration. The present invention is directed primarily to the notch/jaw configuration and the trigger mechanism. In the notch/jaw category, there are two basic design families, namely, a dual motion jaw where both jaw members pivot outwardly from the string path when the trigger release is activated and a single jaw motion where a pivotable jaw moves outwardly from a stationary jaw upon release of the trigger. The subject invention is directed to the single jaw group.

There are several prior art designs which fall into this group of bowstring releases. Some of the earlier designs used an L-shaped pivot member wherein the string retaining element is a cylindrical extension on the short leg of the L. The string retaining element abutted against a stationary surface on the fixed jaw to retain the string. The element was held in place by a trigger mechanism and would pivot away from the stationary surface or abutment when the trigger was released, thereby permitting the bowstring to be released from the retaining system. Various triggering mechanisms could be utilized with this conceptual design without departing from the basic jaw configuration.

A more recent example of this type of design is shown in U.S. Pat. No. 5,765,536 issued to John William Scott on Jun. 16, 1998. The jaw mechanism operates in essentially the same manner as the prior art L-shaped jaw, with the substitution of a string retaining and circumscribing notch to hold the string in place of the cylindrical string retaining element. For the most part, there is very little technical advance over the prior art by the Scott configuration. Any of a number of trigger designs and strap designs could be adapted to this configuration without departing from the basic single jaw mechanism as shown in Scott. The rotating body shown in Scott is substantially shown and described in numerous of the aforementioned Peck patents.

SUMMARY OF THE INVENTION

The subject invention is a new and unique single jaw design which for the first time does not rely directly on an abutment surface to retain the string in the release. The invention also includes a fully calibrated trigger in a single jaw release. This, coupled with the contoured shape of the string retaining member, permits a much more sensitive trigger action than any previous single motion release mechanism. One of the features of this design is that the string is retained at the very tip of the stationary member, assuring a minimum of interference with the string as it is released from the mechanism. The calibration feature of the trigger includes a pitched retaining member, resulting in a trigger load adjustment capability on the order of ten times greater than prior art releases.

In the preferred embodiment of the invention, the release body is fully rotatable relative to a wrist strap, permitting full adjustment to comfort as well as left and right hand use. The trigger is a cam follower lever trigger, with a calibration screw to calibrate and adjust trigger release action. The jaw mechanism includes a stationary member which is integral with the body and a pivotable member mounted in the body and having a roller cam for engaging the trigger mechanism. A single set screw controls the amount of travel of the trigger relative to the cam. The string retaining end of the jaw includes a circumscribing notch having an outer end which is contoured to conform to the string shape when the string is in the fully drawn position. The string retaining end overlaps, rather than abuts, the stationary jaw, permitting the fully drawn sting to be positioned at the very outer tip of the stationary jaw and thereby minimizing interference between the jaw and the string once the string is released.

It has been found that by tapering the outer end of the retaining member, the calibration range is greatly increased. For example, a ten degree pitch has resulted in a ten fold improvement in calibration control.

As is incorporated in many single jaw releases, a compression spring is positioned between the two jaws to hold the mechanism is an open, string retaining position whenever the trigger is in the released position.

It is, therefore, an object of the subject invention to provide a single jaw release wherein the stationary member creates a minimum of interference once the string is released.

It is also an object and feature of the subject invention to provide a single jaw release with a full calibration trigger mechanism.

It is a further object and feature of the subject invention to provide a calibration mechanism with a substantially enhanced range over prior art systems.

It is yet another object and feature of the subject invention to provide a single jaw bowstring release mechanism wherein the movable jaw overlaps rather than abuts the stationary member.

Other objects and features of the invention will be readily apparent from the accompanying drawings and detailed description of the preferred embodiment.

DETAILED DESCRIPTION OF THE PREFERRED EMBODIMENT

Figure 1:
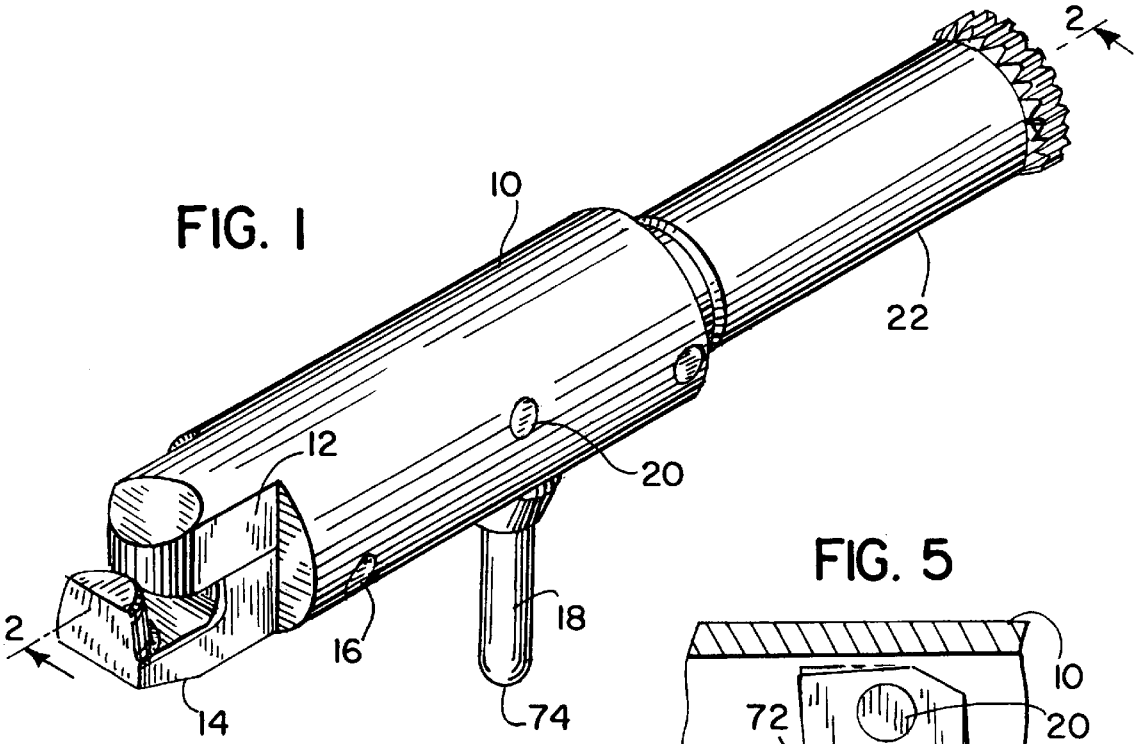
FIG. 1 is a perspective view of a bowstring release in accordance with the subject invention, with the release in the closed, string-retaining position.

The assembled bowstring release of the subject invention is shown in perspective in FIG. 1. In the preferred embodiment, the release mechanism is housed in a cylindrical body 10 including a fixed jaw member 12. The movable jaw member 14 is mounted in the body 10 for rotation about the pivot pin 16. The trigger mechanism 18 is also pivotally mounted in the body at pivot pin 20. A strap receptive extension 22 is mounted for full rotation relative to the body, as better shown in FIG. 2.

Figure 5:
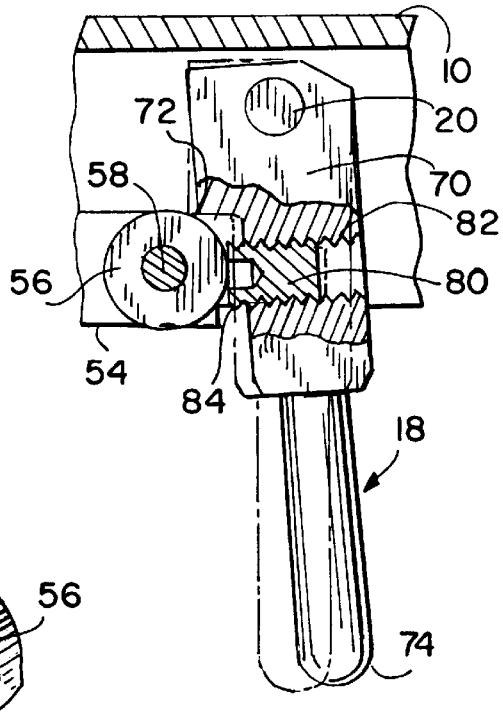
FIG. 5 is a fragmentary view looking in the same direction as FIG. 2 and enlarged for better clarity and detail of the calibration adjustment mechanism of the trigger actuator.
Figures 2, 2A, 3, 4:
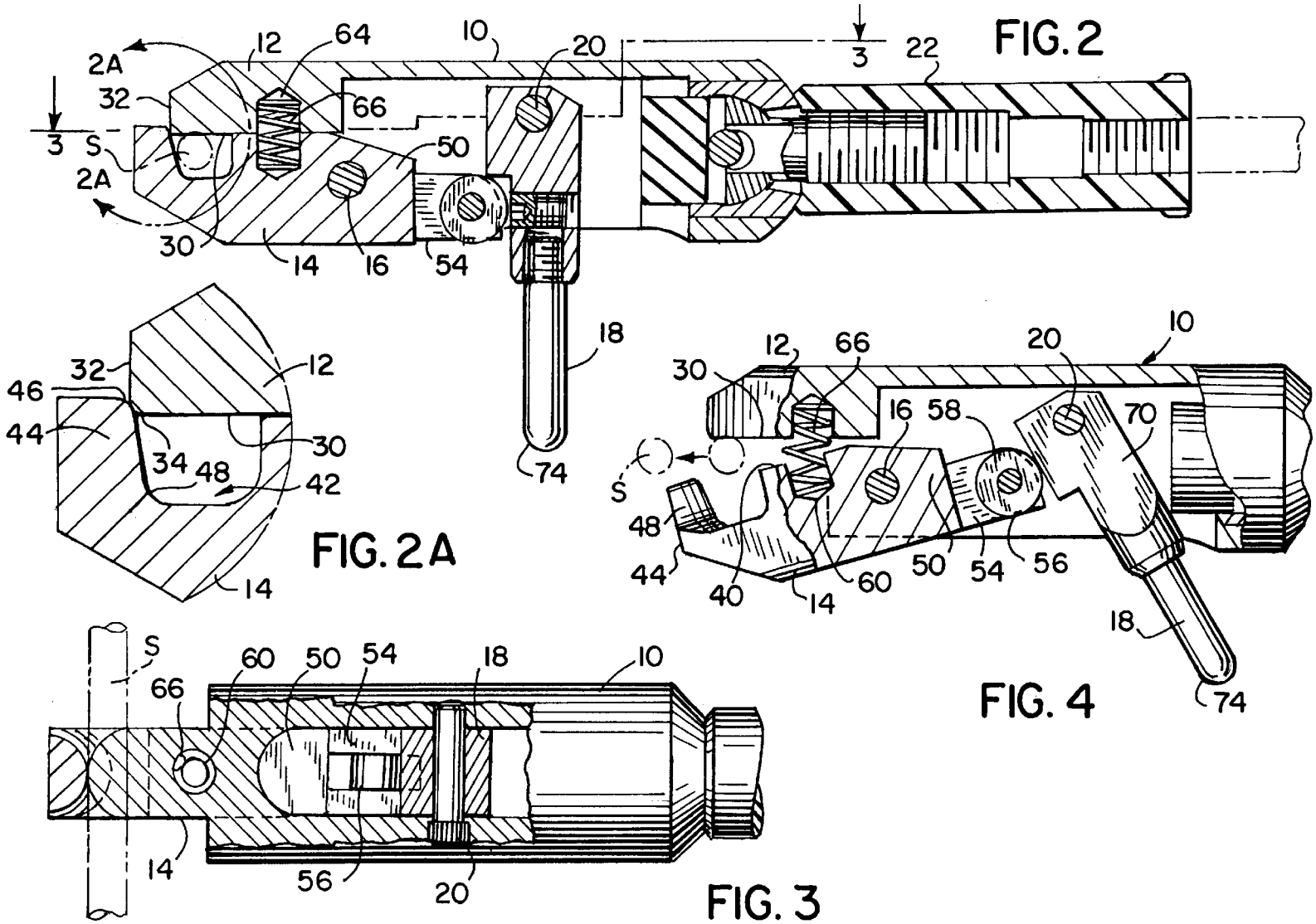
FIG. 2 is a longitudinal sectional view taken along line 2—2 of FIG. 1.
FIG. 2A is an enlarged fragmentary view looking in the same direction as FIG. 2.
FIG. 3 is a sectional view taken along line 3—3 of FIG. 2.
FIG. 4 is a fragmentary view looking in the same direction as FIG. 2, but showing the release in the opened, string releasing position.

As best shown in FIGS. 2, 3 and 5, the jaw mechanism includes the fixed jaw 12, the movable jaw 14 and the trigger actuator 18. The fixed jaw 12 includes a longitudinal, flat guide surface 30 and an outer end 32, with a radiused intersection 34. The radius is not of a critical dimension, but is sufficient to assure that the string S does not snag on the tip or end 32 when it is released. The pivotable jaw 14 includes a mating guide surface 40 (see FIG. 4) which is in abutting alignment with the guide surface 30 of the fixed jaw when the mechanism is closed as shown in FIGS. 2 and 2A.

Figure 6:
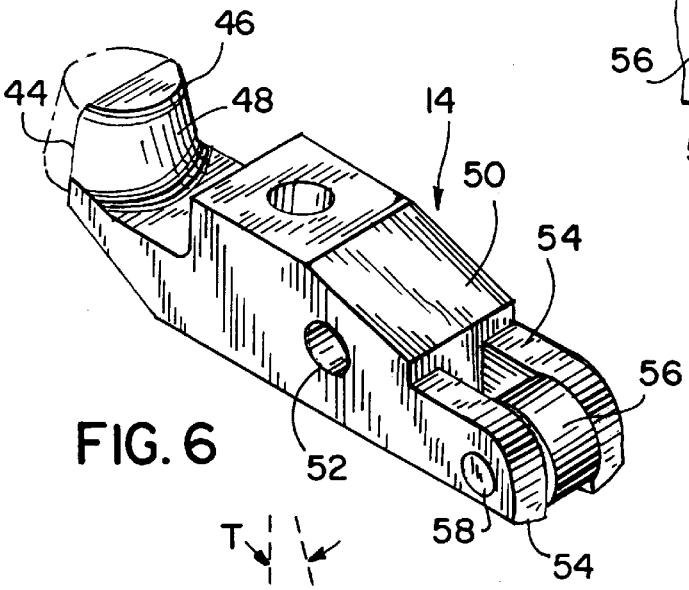
FIG. 6 is a perspective view of the movable jaw member.
Figure 7:
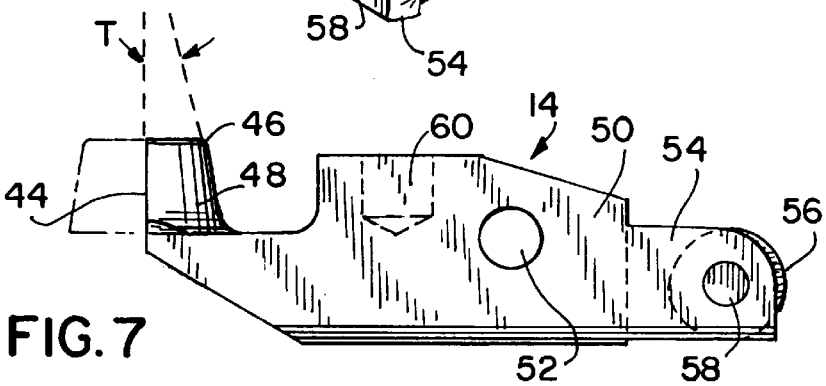
FIG. 7 is a side view of the movable jaw member shown in FIG. 6.

In the preferred embodiment, the outer end of the pivotable jaw includes a string retaining notch 42 and an outer leg 44 which overlaps the outer tip 32 of the fixed jaw. The outer leg 44 is also radiused at 46 to prevent any snagging as the string S is released. As best shown in FIGS. 4, 6 and 7, the string engaging surface 48 of the pivotable jaw is substantially in the form of a truncated, sectioned cone. The circular perimeter or peripheral wall permits the string to ride along a rounded surface when full drawn, reducing any kinking or gouging of the string when under high stress. The axial taper, as indicated at T in FIG. 7, permits a wide range of calibration adjustments as will be further explained.

The inner end 50 of the pivotable jaw 14 includes a through clearance hole 52 for receiving the pivot pin 16 for mounting the jaw in the body 10. A pair of tabs 54 extend outwardly from end 50 for supporting a roller cam 56 on an axle 58. A spring seat 60 is provided and mates with spring seat 64 in the fixed jaw for housing the compression spring 66, which maintains the release in the opened position of FIG. 4 whenever the trigger 18 is in the release position.

The trigger 18 includes a cam engaging member 70 having a cam engaging tip or corner 72. As best shown in FIGS. 4 and 5, when the tip 72 is above the line between the centers of the pivot points 20 and 58, the pivotable jaw 14 is locked in the closed position of FIGS. 1, 2 and 2A. When the actuator lever 74 is pulled back from the roller 58 to a position where the tip 72 moves below the aforementioned line (or over center), the pivotable jaw 14 is released and moves to the opened position of FIG. 4, for releasing the string S.

In the preferred embodiment, the trigger actuator may be adjusted to control the amount of movement required to activate the release. This is accomplished by the use of the single set screw 80 mounted in the tapped hole 82 in the body 70 of the trigger 18. As shown in FIG. 5, as the set screw is advanced or retracted in the hole 82, it controls the amount of movement of the trigger 18 relative to the roller 58 by engaging the roller at screw end or surface 84. This adjusts the amount of trigger action required to engage and disengage the trigger tip 72 from the roller. By providing a taper or pitch T on the string notch surface 48 (see FIG. 7) the adjustment provides an extensive range of calibration. Using a pitch of ten degrees, the calibration range is ten times the range available over a surface 48 of straight taper or zero pitch.

One important feature of the design of the subject invention is the overlapping construction of the pivotable jaw relative to the fixed jaw. As best shown in FIG. 2A, the radiused tips 32 and 46 are in overlapping relationship when the jaw is closed. This permits the notch 42 to be positioned adjacent the outer end 32 along the guide surface 30 of the fixed jaw 12 and reduces the amount of drag or interference caused by the guide surface when the string is released, while still preserving sufficient material in leg 44 of jaw 14 to accommodate full circular and tapered surfaces for maximum design of the notch. The overlapping feature increases strength at the junction of the tips 32 and 46, while at the same time reducing the pinching tendency caused by the drawn string attempting to advance into the opening.

While certain embodiments and features of the invention have been described in detail herein, it will be recognized that the invention includes all of the modifications, enhancements and improvements within the scope and feature of the following claims.

What is claimed is:

1. A bowstring release of the type having a housing with a first jaw fixed relative to the housing and a second jaw movable relative to the housing, and a trigger actuator for engaging and releasing the second jaw for movement between a first, closed, string retaining position and a second, opened, string releasing position, the bowstring release comprising:

a. the first jaw having an elongated guide surface in the general plane of string motion and an outer tip;

b. the second jaw mounted for pivotal movement relative to the first jaw and having a string retaining notch with an outer end adapted for overlapping the outer tip of the first jaw, the second jaw movable between a first, string retaining position wherein the outer end overlaps and engages the outer tip and a second, string releasing position wherein the outer end is removed from overlapping engagement with the outer tip; and c. a trigger actuator movable between a first position for engaging and locking the second jaw in the first, string retaining position and a second position for releasing the second jaw to the second, string releasing position.

2. The bowstring release of claim 1, wherein the outer end of the second jaw further comprises a peripheral surface of contoured, circular cross-section, whereby the string may engage the circular contour of the peripheral surface when in a drawn position.

3. The bowstring release of claim 1, wherein the outer end of the second jaw includes a tapered surface defining a pitch angle tapering outwardly from the longitudinal center line of the second jaw toward the outer tip of the first jaw when the second jaw is in the first, string retaining position.

4. The bowstring release of claim 3, wherein the pitch angle is approximately ten degrees.

5. The bowstring release of claim 3, wherein the pitch angle is less than ten degrees.

6. The bowstring release of claim 3, wherein the pitch angle is ten degrees.

7. The bowstring release of claim 1, wherein the outer end of the second jaw further comprises:

a. a peripheral surface of contoured, circular cross-section, whereby the string may engage the circular contour of the peripheral surface when in a drawn position; and b. a tapered surface defining a pitch angle tapering outwardly from the longitudinal center line of the second jaw toward the outer tip of the first jaw when the second jaw is in the first, string retaining position.

8. The bowstring release of claim 1, wherein the outer end of the second jaw is of a sectioned, truncated conical configuration.

9. The bowstring release of claim 1, wherein the string retaining notch has an outermost string retaining surface which is in alignment with the outer edge of the first jaw when the second jaw is in the first, string retaining position.

10. The bowstring release of claim 1, the trigger actuator further comprising:

a. a trigger engaging surface on the second jaw; and b. a trigger lever mounted for pivotal movement relative to the body and movable between a first, engaged position and a second, released position, the trigger lever having a release element adapted for engaging and locking the trigger engaging surface and the second jaw in the closed, string retaining position when in the first, engaged position and for releasing the trigger engaging surface and permitting movement of the second jaw to the second, string releasing position when in the second, released position.

11. The bowstring release of claim 10, further including a calibration mechanism for adjusting the relative position of the trigger lever to the trigger engaging surface when the trigger lever is in the first, engaged position.

12. The bowstring release of claim 11, wherein the trigger engaging surface on the second jaw is a cam roller and the calibration mechanism is on the trigger lever and comprises a movable element adapted for controlling the relative range of movement between the cam roller and the trigger lever.

13. The bowstring release of claim 12 wherein the movable element is a set screw carried in a tapped hole in the trigger lever and having an outer end adapted for engaging the cam roller.

14. The bowstring release of claim 10, wherein the trigger engaging surface on the second jaw is a cam roller.

15. A bowstring release of the type having a housing with a first jaw fixed relative to the housing and a second jaw movable relative to the housing, and a trigger actuator for engaging and releasing the second jaw for movement between a first, closed, string retaining position and a second, opened, string releasing position, the bowstring release comprising:

a. the first jaw having an elongated guide surface in the general plane of string motion an and outer tip;

b. the second jaw mounted for pivotal movement relative to the first jaw and having a string retaining element adapted for retaining the bowstring in the bowstring release when the second jaw is in the first, string retaining position and for releasing the bowstring when the second jaw is in the second, string releasing position, wherein said string retaining element has a string retaining notch with an outer end adapted for overlapping the outer tip of the first jaw;

c. a trigger engaging surface on the second jaw;

d. a trigger element mounted for pivotal movement relative to the body and movable between a first, engaged position and a second, released position, the trigger element having a release element adapted for engaging and locking the trigger engaging surface and the second jaw in the closed, string retaining position when in the first, engaged position and for releasing the trigger engaging surface and permitting movement of the second jaw to the second, string releasing position when in the second, released position; and e. a calibration mechanism for adjusting the relative position of the trigger element to the trigger engaging surface when the trigger element is in the first, engaged position.

16. The bowstring release of claim 15, wherein the outer end of the second jaw includes a tapered surface defining a pitch angle tapering outwardly from the longitudinal center line of the second jaw toward the outer tip of the first jaw when the second jaw is in the first, string retaining position.

17. The bowstring release of claim 15, wherein the trigger engaging surface is on the second jaw and the calibration mechanism is on the trigger element, the calibration mechanism comprising a movable element adapted for controlling the relative range of movement between the trigger engaging surface and the trigger element.

18. A bowstring release comprising:

a. a housing;

b. a first jaw mounted on said housing, said first jaw having an outer end with an outer tip; and c. a second jaw mounted on said housing, said second jaw having an outer end with an outer tip, d. at least one jaw movable between a first, string retaining position wherein one jaw is offset from the other jaw such that the outer ends of the two jaws are offset relative to one another and the outer tip of the offset jaw overlaps the outer tip of the other jaw, to a second, string releasing position wherein the outer end is removed from overlapping with the outer tip.

* * * * *

UNITED STATES PATENT AND TRADEMARK OFFICE

CERTIFICATE OF CORRECTION

PATENT NO. : 6,058,920
DATED : May 9, 2000
INVENTOR(S) : Tentler et al.

It is certified that error appears in the above-identified patent and that said Letters Patent is hereby corrected as shown below:

Title page,
Item [75] Jeffrey A. Eckert, North Fond du Lac, WI is added as an inventor.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*